US011846471B2

(12) United States Patent
Avila et al.

(10) Patent No.: US 11,846,471 B2
(45) Date of Patent: Dec. 19, 2023

(54) SHELL AND TUBE HEAT EXCHANGER WITH COMPOUND TUBESHEET

(71) Applicant: CARRIER CORPORATION, Palm Beach Gardens, FL (US)

(72) Inventors: Luis Felipe Avila, Manlius, NY (US); Jefferi J. Covington, Baldwinsville, NY (US); Tobias H. Sienel, Baldwinsville, NY (US); Brian D. Videto, Cortland, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 17 days.

(21) Appl. No.: 17/253,004

(22) PCT Filed: Jun. 30, 2020

(86) PCT No.: PCT/US2020/040251
§ 371 (c)(1),
(2) Date: Dec. 16, 2020

(87) PCT Pub. No.: WO2021/011184
PCT Pub. Date: Jan. 21, 2021

(65) Prior Publication Data

US 2022/0187024 A1 Jun. 16, 2022

Related U.S. Application Data

(60) Provisional application No. 62/873,571, filed on Jul. 12, 2019.

(51) Int. Cl.
*F28D 7/16* (2006.01)
*F28F 9/02* (2006.01)
(Continued)

(52) U.S. Cl.
CPC ..... *F28D 7/16* (2013.01); *F28F 9/0273* (2013.01); *F28F 9/26* (2013.01); *F28F 19/002* (2013.01);
(Continued)

(58) Field of Classification Search
CPC ..... F28D 7/16; F28F 9/02; F28F 19/00; F28F 21/06; F28F 21/08; F28F 9/26; F28F 9/023; F28F 19/002; F28F 21/084; F28F 21/062
See application file for complete search history.

(56) References Cited

U.S. PATENT DOCUMENTS 3,882,024 A * 5/1975 Holmes ..... B01D 65/00 210/450
4,830,825 A * 5/1989 Goto ..... C22C 9/01 420/488
(Continued)

FOREIGN PATENT DOCUMENTS

CN 107101423 A 8/2017
CN 108195207 A 6/2018
(Continued)

OTHER PUBLICATIONS

Invitation to Pay Additional Fees dated Oct. 15, 2020.
ISR/WO; Application No. PCT/US2020/040251; dated Dec. 7, 2020, 17 Pages.

*Primary Examiner* — Harry E Arant
(74) *Attorney, Agent, or Firm* — CANTOR COLBURN LLP

(57) ABSTRACT

Disclosed is a shell-and-tube heat exchanger assembly, having: a first tubesheet configured for being secured to a shell of the shell-and-tube heat exchanger assembly, the first tubesheet including: a first section and a second section; the second section configured to be secured to a first shell end of the shell; and the first section including a plurality of
(Continued)

holes configured to support a respective plurality of aluminum tubes extending through the shell, wherein the first section is configured to limit a galvanic response of the plurality of aluminum tubes when exposed to a chiller water.

15 Claims, 7 Drawing Sheets

(51) Int. Cl.

| | |
|---|---|
| ***F28F 9/26*** | (2006.01) |
| ***F28F 19/00*** | (2006.01) |
| ***F28F 21/06*** | (2006.01) |
| ***F28F 21/08*** | (2006.01) |

(52) U.S. Cl.
CPC ..... *F28F 21/062* (2013.01); *F28F 21/084* (2013.01); *F28F 2275/06* (2013.01)

(56) References Cited

U.S. PATENT DOCUMENTS

| | | | | |
|---|---|---|---|---|
| 2006/0096736 | A1 | 5/2006 | Burkhalter et al. | |
| 2014/0216703 | A1* | 8/2014 | Yi | F28F 3/02 165/185 |
| 2015/0122455 | A1 | 5/2015 | Fox et al. | |
| 2018/0112925 | A1* | 4/2018 | Zanardi | F28D 7/1607 |
| 2018/0236618 | A1* | 8/2018 | Scholz | F28F 21/084 |

FOREIGN PATENT DOCUMENTS

| | | | | |
|---|---|---|---|---|
| DE | 102004023027 | A1 * | 12/2005 | F16L 58/1045 |
| EP | 2454546 | B1 | 9/2015 | |
| KR | 20170014315 | A * | 2/2017 | |
| KR | 20170014315 | A | 2/2017 | |

* cited by examiner

SHELL AND TUBE HEAT EXCHANGER WITH COMPOUND TUBESHEET

CROSS REFERENCE TO RELATED APPLICATIONS

This application is a US National Stage of Application No. PCT/US2020/040251, filed on Jun. 30, 2020, which claims the benefit of U.S. Provisional Application No. 62/873,571, filed on Jul. 12, 2019, the disclosures of which are incorporated herein by reference in their entirety.

BACKGROUND

Exemplary embodiments pertain to a shell-and-tube heat exchanger and more specifically to a shell-and-tube heat exchanger with a compound tubesheet.

A shell-and-tube heat exchanger is a class of heat exchanger that includes a shell and a bundle of tubes inside the shell. When aluminum tubes are used in a steel shell, due to fouling and corrosion, these heat exchangers may experience wall thinning of the tubes beyond allowable limits. This is due to the high galvanic corrosion pairing between dissimilar metals. For continuous operation of such heat exchangers, the tubes may be replaced on a regular basis, causing an operation shut down.

BRIEF DESCRIPTION

Disclosed is a shell-and-tube heat exchanger assembly, comprising: a first tubesheet configured for being secured to a shell of the shell-and-tube heat exchanger assembly, the first tubesheet including: a first section and a second section, the second section configured to be secured to a first shell end of the shell: and the first section including a plurality of holes configured to support a respective plurality of aluminum tubes extending through the shell, wherein the first section is configured to limit a galvanic response of the plurality of aluminum tubes when exposed to a chiller water.

In addition to one or more of the above disclosed features, or as an alternate the first section comprises a cladded metal.

In addition to one or more of the above disclosed features, or as an alternate the first section comprises an insert.

In addition to one or more of the above disclosed features, or as an alternate the first section comprises a polymer.

In addition to one or more of the above disclosed features, or as an alternate the first section has a rectangular surface area and is secured to a cutout in the second section, wherein the cutout is rectangular.

In addition to one or more of the above disclosed features, or as an alternate the first section is press fit into the second section.

In addition to one or more of the above disclosed features, or as an alternate the first section is welded to the second section.

In addition to one or more of the above disclosed features, or as an alternate the first section is water-tight secured to the second section.

In addition to one or more of the above disclosed features, or as an alternate the assembly includes a first plenum secured to the first section, the first section having a surface area that is at least as large as a contact area between the first plenum and the first section.

In addition to one or more of the above disclosed features, or as an alternate the first tubesheet is formed from a polymer.

In addition to one or more of the above disclosed features, or as an alternate the first tubesheet comprises a hub-spoke-wheel subassembly.

In addition to one or more of the above disclosed features, or as an alternate the first section comprises a hub section of the hub-spoke-wheel subassembly, the second section comprises a wheel section of the hub-spoke-wheel subassembly, and a third section of the assembly comprises a spoke section of the hub-spoke-wheel subassembly, the third section being radially between and interconnecting the first section and the second section.

In addition to one or more of the above disclosed features, or as an alternate the second section includes a first groove that is axially extending and configured to receive a first shell end of the shell.

In addition to one or more of the above disclosed features, or as an alternate the second section includes a disc member that is integral with the second section.

In addition to one or more of the above disclosed features, or as an alternate the second section includes a plurality of spokes that are radially extending and circumferentially spaced from each other about the disc member.

In addition to one or more of the above disclosed features, or as an alternate the first section includes a second groove that is radially extending and configured to be secured to the disc member and the plurality of spokes.

In addition to one or more of the above disclosed features, or as an alternate the plurality of spokes are axially forward of the disc member and have a radial outer-side secured to a radial underside of the second section.

In addition to one or more of the above disclosed features, or as an alternate the assembly includes a second tubesheet that is materially the same as the first tubesheet.

In addition to one or more of the above disclosed features, or as an alternate the plurality of aluminum are supported by the plurality of holes in the first section, and wherein the first section comprises aluminum.

Further disclosed is a method of directing fluid through a shell-and-tube heat exchanger assembly comprising: directing a first fluid through a plurality of tubes extending through a shell: and directing a second fluid through the shell, exterior to the plurality of aluminum tubes, without causing a corrosive reaction between the aluminum tubes and a first tubesheet of the shell-and-tube heat exchanger assembly.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
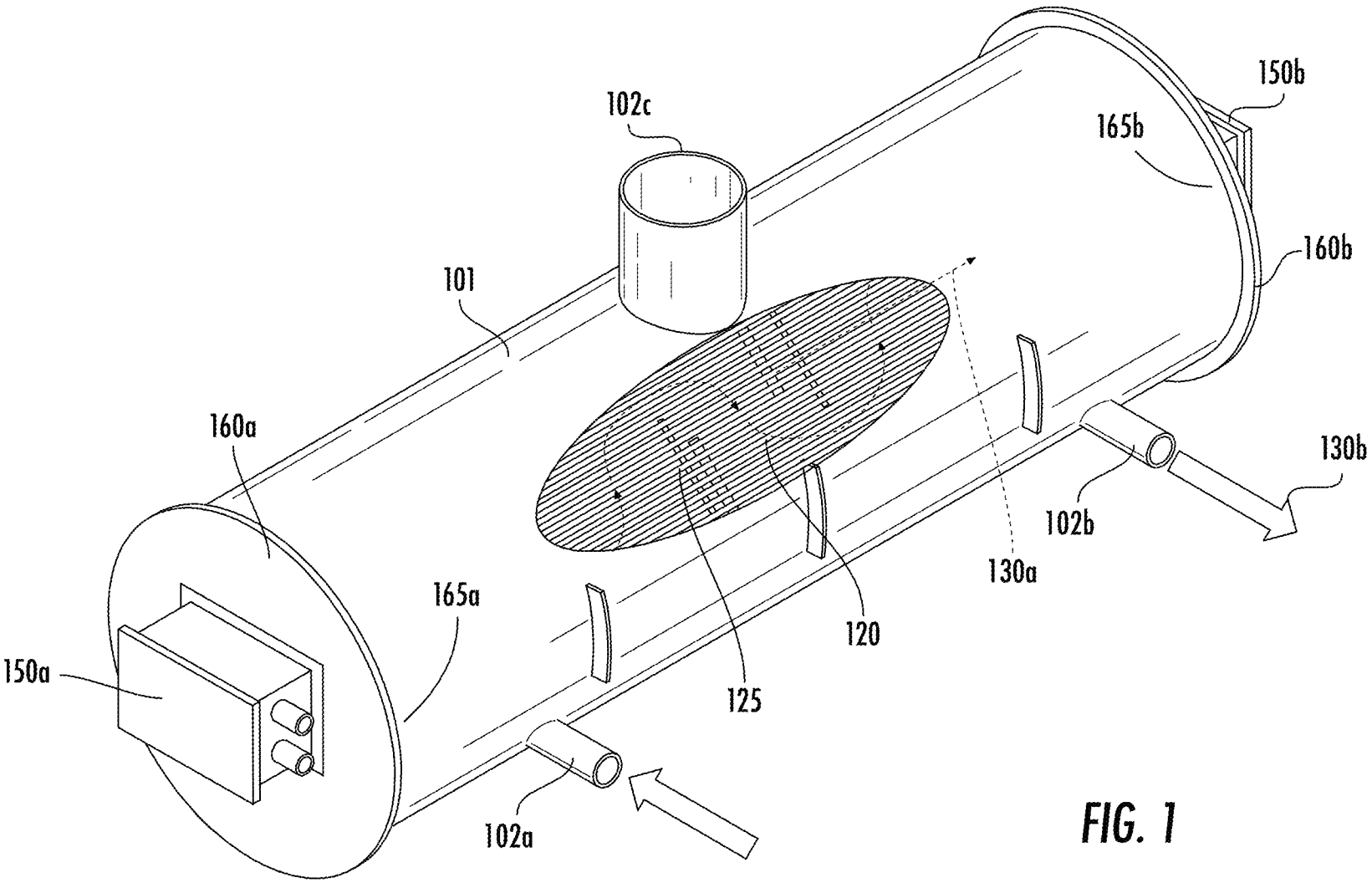
FIG. 1 illustrates a shell-and-tube heat exchanger assembly according to the disclosure.
Figure 2:
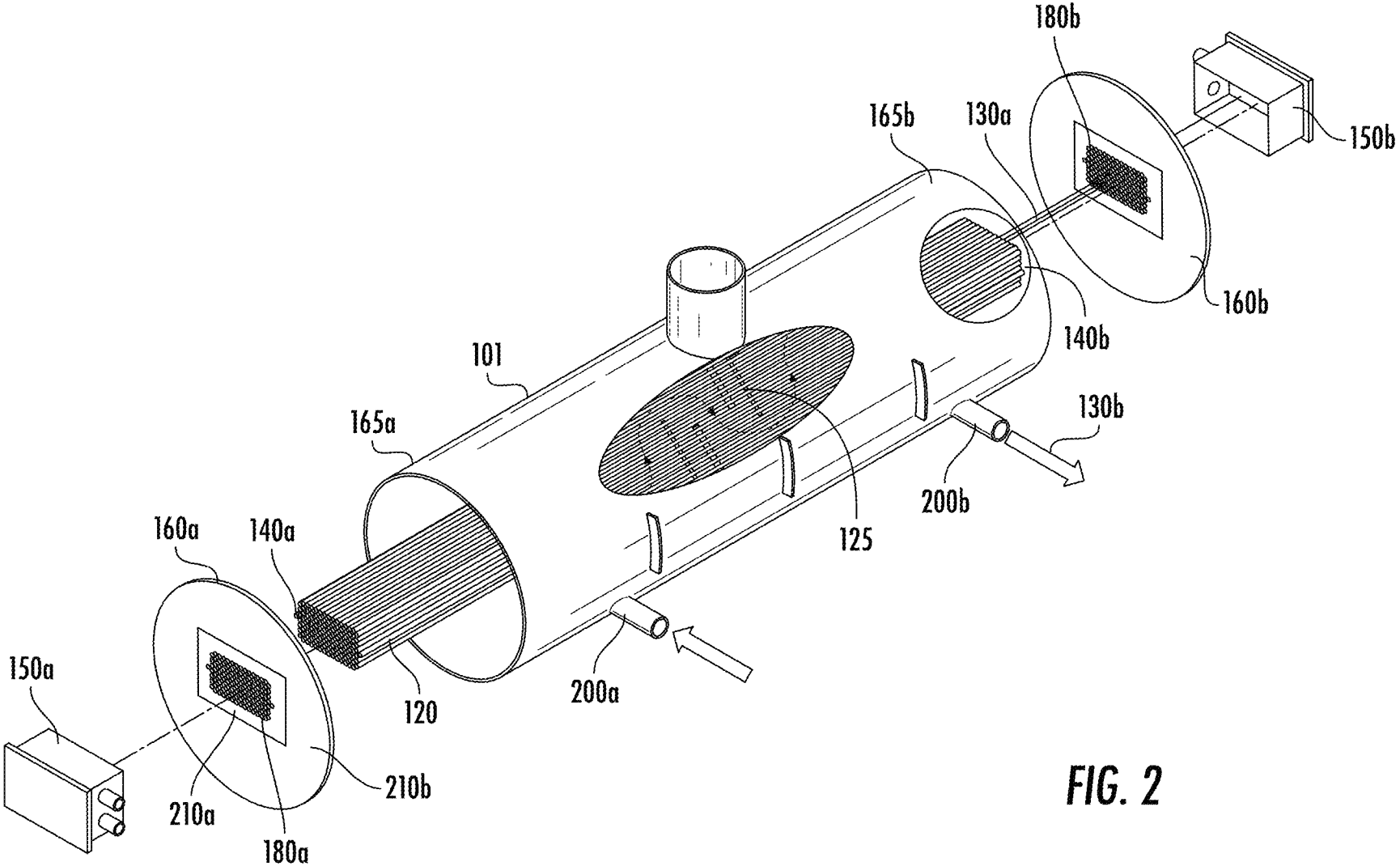
FIG. 2 illustrates an exploded view of a shell-and-tube heat exchanger assembly according to an embodiment.

Turning to FIGS. 1-2, illustrated is a shell-and-tube heat exchanger assembly (assembly) 100, which comprises a shell 101, i.e., a large vessel, and a plurality of aluminum tubes (aluminum tubes) 120 bundled inside the shell 101. The shell 101 may have a plurality of ports (ports) 102 including a first port 102*a* and a second port 102*b*, which may be an upstream port and a downstream port, respectively. Within this disclosure, the terms upstream and downstream are relative to a direction of flow for fluid within the aluminum tubes 120. The shell 101 may also have an exhaust port 102*c* to exhaust vapor formed within the shell 101 during a heat transfer cycle.

Within the shell 101 there may be one or more baffles 125 (illustrated schematically in FIG. 1), though embodiments without baffles 125 are within the scope of the disclosure. The assembly 100 may include a plurality of plenums (plenums) 150 (sometimes called water-boxes) including a first plenum 150*a* and a second plenum 150*b*, which may be an upstream plenum and a downstream plenum, respectively. The plenums 150 may be connected to the shell 101 through a plurality of tubesheets (tubesheets) 160, including a first tubesheet 160*a* and a second tubesheet 160*b*, which may be an upstream tubesheet and a downstream tubesheet, respectively. The tubesheets 160 are secured to a plurality of shell ends (shell ends) 165 including a first shell end 165*a* and a second shell end 165*b*, which may be an upstream shell end and a downstream shell end, respectively.

The assembly 100 is designed to allow a plurality of fluids (fluids) 130 including a first fluid 130*a* and a second fluid 130*b* of different starting temperatures to flow through it. The first fluid 130*a* flows through the aluminum tubes 120 (the tube side), while the second fluid 130*b* flows in the shell (the shell side) but outside the aluminum tubes 120. Heat is transferred between the fluids 130 through the aluminum tubes 120, either from tube side to shell side or vice versa. The fluids 130 may be either liquids or gases on either the shell or the tube side. In order to transfer heat efficiently, a large heat transfer area is generally used, requiring many aluminum tubes 120, which are usually disposed horizontally inside the shell 101, which may be a cylindrical tank-like structure.

Turning to FIG. 2, additional features of the assembly 100 are shown. FIG. 2 includes each of the features of FIG. 1. As illustrated in FIG. 2, the aluminum tubes 120 have opposing tube ends 140 including a first tube end 140*a* and a second tube end 140*b*, which may be an upstream tube end and a downstream tube end, respectively. The opposing tube ends 140 are connected to the plenums 150 through the tubesheets 160. The tubesheets 160 may each include a plurality of holes (holes) 180, which are tube support holes, including a first set of tube support holes (first holes) 180*a* in the first tubesheet 160*a* and a second set of tube support holes (second holes) 180*b* in the second tubesheet 160*b*.

The shell 101 may be formed of steel. In the embodiment of FIG. 2, the tubesheets 160 may be formed at least partially of steel to properly weld to the shell 101. The aluminum tubes 120 may be thin walled. If the tubesheets 160 were formed entirely of untreated steel, the aluminum tubes 120 and tubesheets 160 may chemically react over time, especially when the fluids 130 are conductive, like water, resulting in corrosion of the aluminum tubes 120. The first tube end 140*a*, which is the upstream end, may corrode at a higher rate than the second tube end 140*b*, which is the downstream end. This may occur due to the larger differential in temperatures between the first fluid 130*a* and second fluid 130*b* at the upstream end compared with the downstream end.

According to the disclosed embodiments one of the tubesheets 160, for example the first tubesheet 160*a*, may be a compound tubesheet that may include a plurality of sections (sections) 210 including a first section 210*a* and a second section 210*b*. The first section 210*a* may include the holes 180 and the second section 210*b* may be secured to the shell 101. For example, the first section 210*a* may be a radially inner section and the second section 210*b* is a radially exterior section.

In one embodiment, the first tubesheet 160*a* has a circular surface area and the first section 210*a* has a rectangular surface area. In one embodiment a diameter D1 of the first tubesheet 160*a* is larger than each perimeter edge 215 of the first section 210*a*. With this configuration, and with the first section 210*a* centered in the first tubesheet 160*a*, the first section 210*a* will avoid direct contact with the shell 101. The sections 210 may comprise different materials, discussed below, so that this configuration may avoid engaging the shell 101 with different materials and potentially compromising a strength of connection between the second section 210*b* and the shell 101.

In one embodiment, a useful life of the assembly 100 is determined in advance and the extent of galvanization of the first section 210*a* is such as to protect the aluminum tubes 120 during the useful life of the assembly 100. As such, downtime for replacing the aluminum tubes 120 due to corrosion at the first tubesheet 160*a* may be avoided.

In one embodiment, the first section 210*a* and the second section 210*b* are formed of a continuous base material such as steel. The first section 210*a* may be cladded. The cladding may be a rolled-in thin metallic layer of aluminum or a suitable alloy, a spray coat, or other commercial process of cladding metal. The cladding material can be any material that is more electrochemically negative than the aluminum tubes when exposed to chiller water. For example, materials with a lower electrochemical potential than the aluminum tubes when exposed to chiller water, e.g., the cladding can be a more electrochemically active Al alloy (e.g., including zinc and/or magnesium), pure zinc, pure magnesium, and the like.

Figure 3:
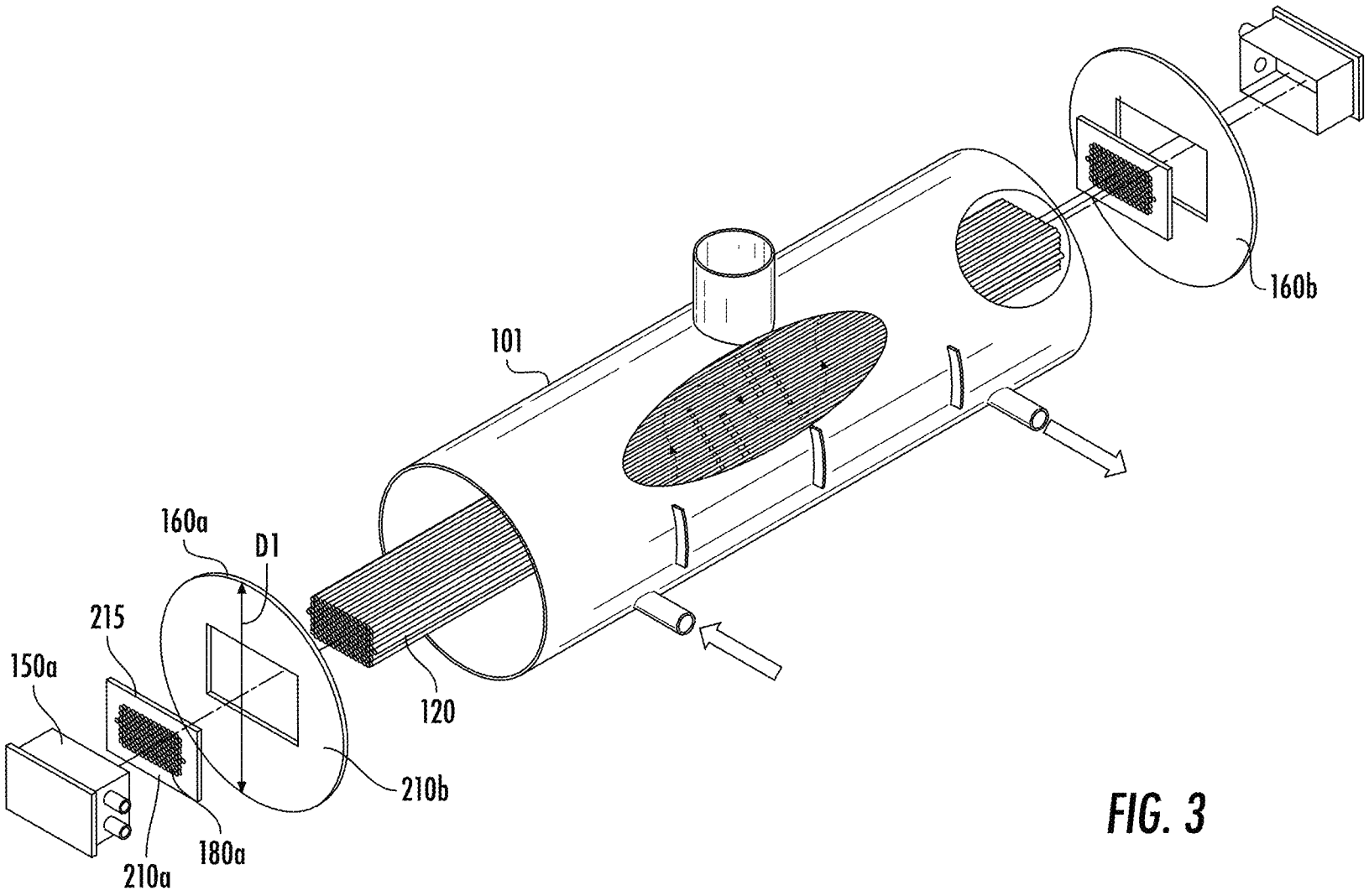
FIG. 3 illustrates an exploded view of a shell-and-tube heat exchanger assembly according to another embodiment.

Turning to FIG. 3, a further embodiment is illustrated. Features of the assembly 100 illustrated in FIGS. 1 and 2 are included in this embodiment unless otherwise indicated. In the embodiment in FIG. 3, the second section 210*b* includes a cutout 220 and the first section 210*a* is an insert that is secured to the second section 210*b* within the cutout 220. In such embodiment the second section 210*b* may be steel w % bile the first section 210*a* may be the same material as the aluminum tubes 120, or a material that is configured to limit a galvanic response of the plurality of aluminum tubes 120 when exposed to a chiller water. Though chemical reactions may occur between the first section 210*a* and the second section 210*b*, the first section 210*a* may be configured to survive the useful life of the assembly 100. For example, the first section 210*a* may be formed of a relatively thick aluminum plate. In one embodiment, the first section 210*a*, configured as an insert, is a polymer. For example, the polymer can include monomers, copolymers, liquid crystal (LCP), polysulfone (PSU), polyethersulfone (PES), polyvinylidene fluoride (PVDF), polyetherimide (PEI), polyphenylene sulfide (PPS), polyetheretherketone (PEEK), styrene butadiene copolymers (SBC), polyketone (PK), and the like. The polymer can include reinforcing material, for example aramid fiber, glass fiber, carbon fiber, carbon nanotube, reinforcing materials, and the like. The joint between the insert and the tubesheet may be mechanical (e.g., bolt and flange), welded, inserted, glued, etc., for securing the insert to the tubesheet.

Chiller water as used herein can include pure water, potable water, brines (e.g., saltwater, polyethylene, polypropylene, and the like), and treated water including additives such as corrosion inhibiters or antifreeze, and the like.

In one embodiment a surface size of the first section 210*a* of the first tubesheet 160*a* is as large, or larger, than a contact area between the first plenum 150*a* and the first tubesheet 160*a*. This avoids a configuration where the first plenum 150*a* is disposed on an uneven surface that is not water-tight when, for example, the first section 210*a* is a different thickness than the second section 210*b*. The first section 210*a* may be press fit into the second section 210*b*, welded to the second section 210*b*, or secured by another leak tight process. With such embodiment, first tubesheet 160*a* may be a template for use with different chillers requiring different configurations of holes 180 and/or different materials for the first section 210*a* due to the use of different aluminum tubes 120 (e.g., having different thickness, outside diameter, flow area, and the like). That is, the first section 210*a* may be interchanged for different operating parameters.

In the embodiment illustrated in FIG. 3, the second tubesheet 160*b* may be configured the same as the first tubesheet 160*a*. As such, further discussion of the configuration of the second tubesheet 160*b* is omitted for brevity.

Figure 4:
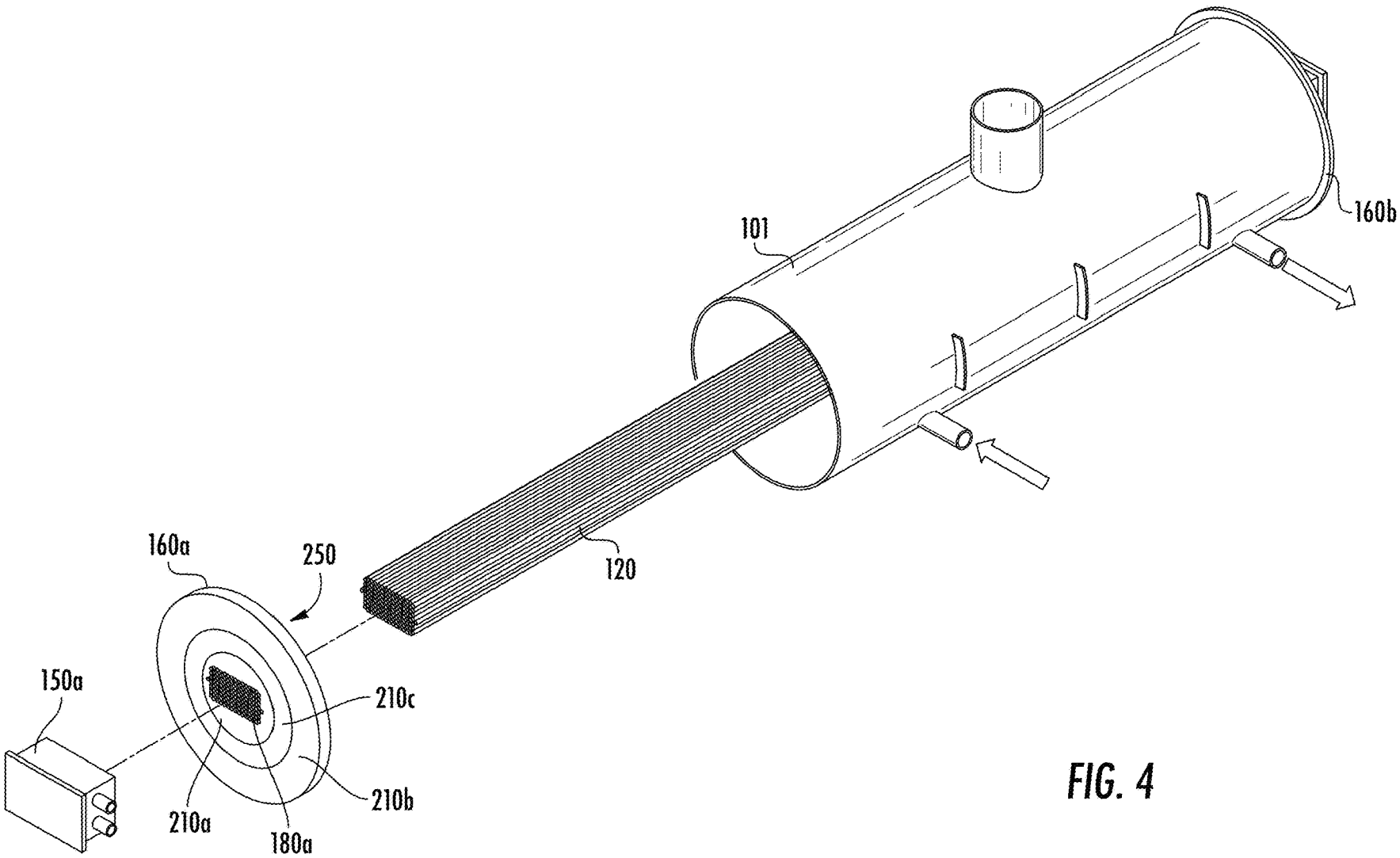
FIG. 4 illustrates an exploded view of a shell-and-tube heat exchanger assembly according to another embodiment.
Figure 5:
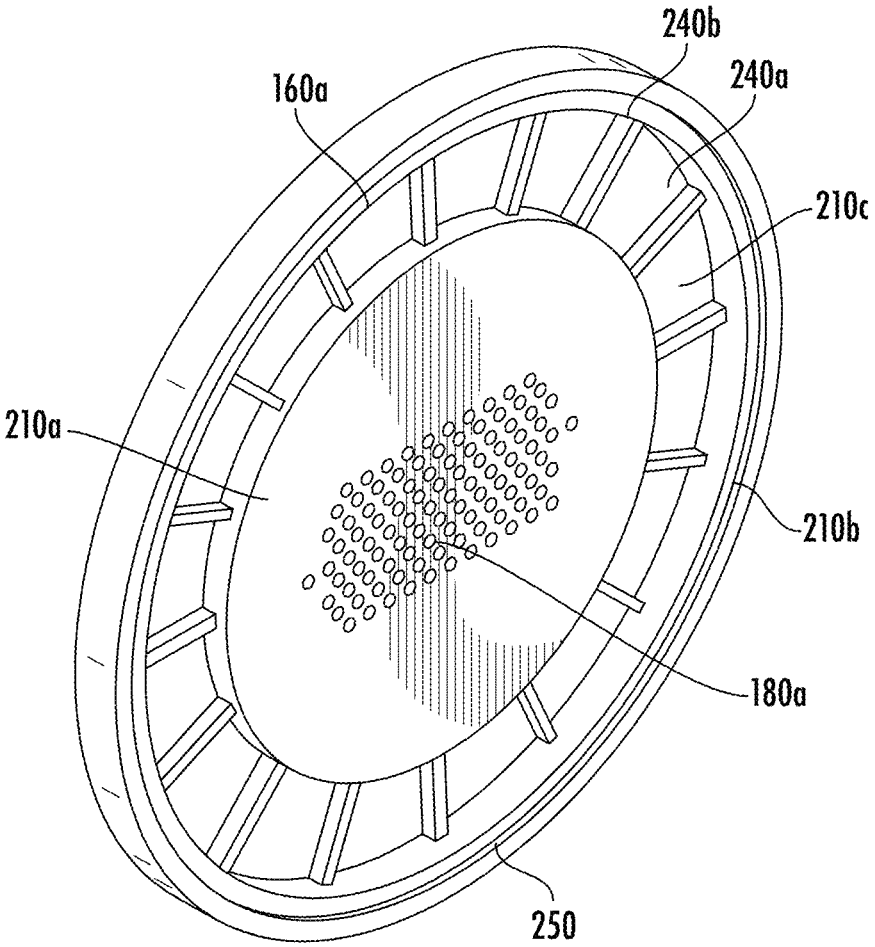
FIG. 5 illustrates a tubesheet for the shell-and-tube heat exchanger assembly of FIG. 4 in which the tubesheet is a polymer/plastic.
Figure 6:
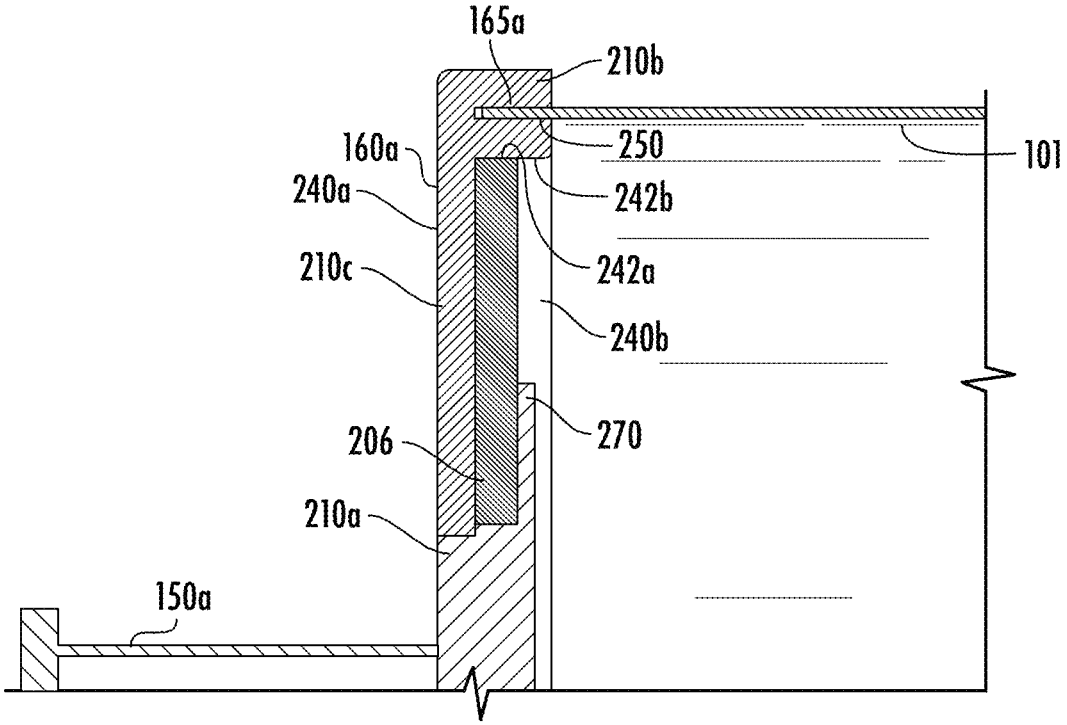
FIG. 6 illustrates a portion of the shell-and-tube heat exchanger assembly of FIG. 4 in which the tubesheet is a polymer/plastic.

Turning to FIGS. 4-6, a further embodiment is illustrated. Features of the assembly 100 illustrated in FIGS. 1 and 2 are included in this embodiment unless otherwise indicated. In the embodiment of FIGS. 4-6, first tubesheet 160*a* is a disc shaped polymer with a hub-spoke-wheel subassembly.

In such embodiment the first section 210*a* is a hub section that includes the holes 180, and the first plenum 150*a* is secured to the first section 210*a* (FIG. 6). The second section 210*b* is a wheel section that is annular and connects with the shell 101 through a first groove 250 that is axially extending. A third section 210*c* of the assembly 100 is a spoke section that is annular and extends radially between the first section 210*a* and the second section 210*b*. The third section 210*c* has a disc member 240*a* that is radially extending and integral with the second section 210*b*. The third section 210*c* has a plurality of spokes (spokes) 240*b* that are circumferentially spaced from each other and radially extending. The spokes 240*b* are axially forward of the disc member 240*a* and serve to strengthen the third section 210*c*. A radial outer-side 242*a* of the spokes 240*b* contacts a radial underside 242*b* of the second section 210*b* for providing radial support. A second groove 260 is radially extending in the first section 210*a* receives both of the disc member 240*a* and the spokes 240*b*, where a forward portion 270 of the second groove 260 forms a flange that is secured against the spokes 240*b*. The features of FIG. 5 are one example of a configuration providing a structurally sound geometric design for the polymer/plastic tubesheet. Other designs resulting in a structurally sound geometric design for the polymer/plastic tubesheet are within the scope of this disclosure. It is to be appreciated that the features of FIG. 6 represent one embodiment of the disclosure and is not intended to limit the scope of the disclosure.

In the embodiment illustrated in FIGS. 4-6, the second tubesheet 160*b* may be configured the same as the first tubesheet 160*a*. As such, further discussion of the configuration of the second tubesheet 160*b* is omitted for brevity.

Figure 7:
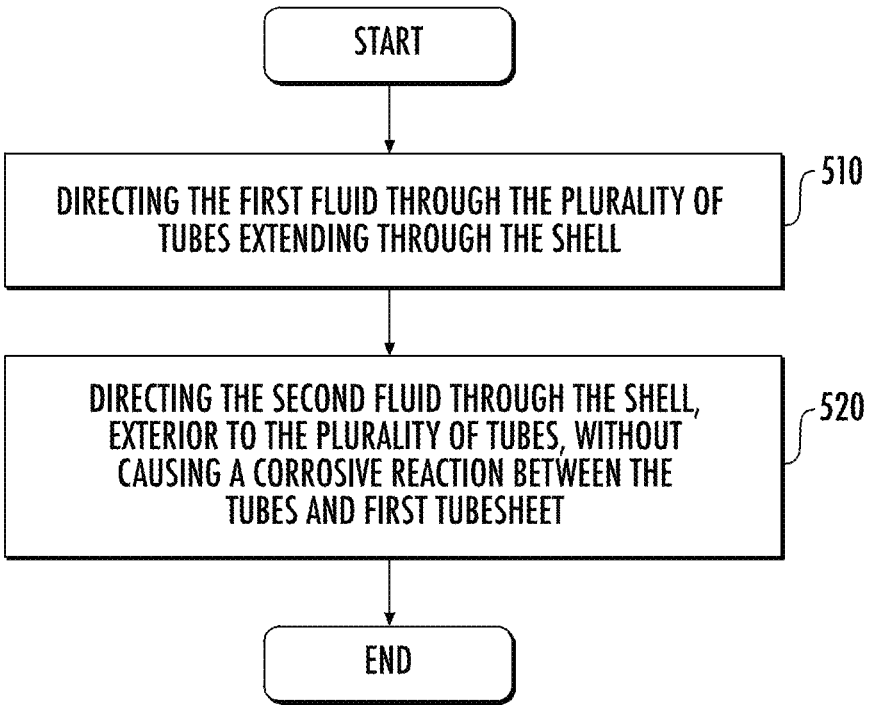
FIG. 7 illustrates a method of directing fluid through a shell-and-tube heat exchanger assembly.

FIG. 7 discloses a method of directing fluid through the assembly 100. As illustrated in block 510 the method includes directing the first fluid 130*a* through the aluminum tubes 120 extending through the shell 101. Block 520 illustrates directing the second fluid 130*b* through the shell 101, exterior to the aluminum tubes 120, without causing a corrosive reaction between the aluminum tubes 120 and the first tubesheet 160*a*.

With the above embodiments, a galvanic pairing between the aluminum tubes 120 and support structure of the assembly 100 may be selectively eliminated at one or both of the tubesheets 160.

The term "about" is intended to include the degree of error associated with measurement of the particular quantity based upon the equipment available at the time of filing the application. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A shell-and-tube heat exchanger assembly, comprising:

a first tubesheet configured for being secured to a shell of the shell-and-tube heat exchanger assembly, the first tubesheet including:

a first section and a second section;

the second section configured to be secured to a first shell end of the shell; and the first section including a plurality of holes configured to support a respective plurality of aluminum tubes extending through the shell, wherein the first section is configured to limit a galvanic response of the plurality of aluminum tubes when exposed to a chiller water, wherein:

the first section is a radially inner section and the second section is a radially exterior section;

the first section is an insert having a rectangular surface area that is press fit or welded into a cutout in the second section, the second section being disc shaped; and a first plenum that is a water-box secured to the first section, the first section having a surface area that is at least as large as a contact area between the first plenum and the first section.

2. The assembly of claim 1, wherein the first section comprises a cladded metal.

3. The assembly of claim 1, wherein the first section comprises a polymer.

4. The assembly of claim 1, wherein the first section is water-tight secured to the second section.

5. The assembly of claim 1, wherein the first tubesheet is formed from a polymer.

6. The assembly of claim 5, wherein the first tubesheet comprises a hub-spoke-wheel subassembly.

7. The assembly of claim 6, wherein the first section comprises a hub section of the hub-spoke-wheel subassembly, the second section comprises a wheel section of the hub-spoke-wheel subassembly, and a third section of the assembly comprises a spoke section of the hub-spoke-wheel subassembly, the third section being radially between and interconnecting the first section and the second section.

8. The assembly of claim 7, wherein the second section includes a first groove that is axially extending and configured to receive a first shell end of the shell.

9. The assembly of claim 8, wherein the third section includes a disc member that is integral with the second section.

10. The assembly of claim 9, wherein the second section includes a plurality of spokes that are radially extending and circumferentially spaced from each other about the disc member.

11. The assembly of claim 10, wherein the first section includes a second groove that is radially extending and configured to be secured to the disc member and the plurality of spokes.

12. The assembly of claim 10, wherein the plurality of spokes are axially forward of the disc member and have a radial outer-side secured to a radial underside of the second section.

13. The assembly of claim 1, comprising a second tubesheet that is materially the same as the first tubesheet.

14. The assembly of claim 1, wherein the plurality of aluminum tubes are supported by the plurality of holes in the first section, and wherein the first section comprises aluminum.

15. A method of directing fluid through shell-and-tube heat exchanger assembly of claim 1, the method comprising:

directing a first fluid through a plurality of tubes extending through a shell; and directing a second fluid through the shell, exterior to the plurality of aluminum tubes, without causing a corrosive reaction between the aluminum tubes and the first tubesheet of the shell-and-tube heat exchanger assembly.

* * * * *